US009523244B2

(12) United States Patent
Heisig

(10) Patent No.: US 9,523,244 B2
(45) Date of Patent: Dec. 20, 2016

(54) DRILL BIT FOR A DRILLING APPARATUS

(71) Applicant: SCIENTIFIC DRILLING INTERNATIONAL, INC., Houston, TX (US)

(72) Inventor: Gerald Heisig, Houston, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 351 days.

(21) Appl. No.: 13/683,540

(22) Filed: Nov. 21, 2012

(65) Prior Publication Data

US 2014/0138157 A1 May 22, 2014

(51) Int. Cl.
*E21B 7/04* (2006.01)
*E21B 17/04* (2006.01)
*E21B 7/06* (2006.01)

(52) U.S. Cl.
CPC ..... *E21B 17/04* (2013.01); *E21B 7/064* (2013.01)

(58) Field of Classification Search
USPC ..... 175/73, 40, 107, 371
See application file for complete search history.

(56) References Cited

U.S. PATENT DOCUMENTS 1,334,632 A * 3/1920 Pickin ..... E21B 10/083 175/228
4,354,559 A 10/1982 Johnson
4,739,842 A 4/1988 Kruger et al.
5,803,187 A * 9/1998 Javins ..... 175/57
5,967,246 A * 10/1999 Caraway et al. ..... 175/393
5,979,570 A * 11/1999 McLoughlin et al. ..... 175/24
6,290,002 B1 * 9/2001 Comeau et al. ..... 175/73
7,287,605 B2 10/2007 Van Steenwyk et al.
2002/0185315 A1 * 12/2002 McLoughlin et al. ..... 175/76
2006/0090935 A1 * 5/2006 Van Steenwyk et al. ..... 175/73
2007/0272443 A1 * 11/2007 Hall et al. ..... 175/61

FOREIGN PATENT DOCUMENTS

EP 0163946 B1 4/1989

OTHER PUBLICATIONS

International Search Report and Written Opinion for International Application No. PCT/US13/66560, mailed on Mar. 21, 2014 (7 pages).
Office Action issued in Chinese Application No. 201380068557.2, dated Apr. 5, 2016, 12 pages.

* cited by examiner

*Primary Examiner* — Taras P Bemko
(74) *Attorney, Agent, or Firm* — Adolph Locklar

(57) ABSTRACT

A down-hole drilling apparatus includes a bearing housing defining a longitudinal axis and upper and lower portions. The upper portion of the bearing housing is configured for connection to a drill string, and at least one annular bearing package disposed within the bearing housing. A drill bit is coupled to the bearing housing and rotatable with respect to the longitudinal axis. The drill bit includes a leading body supporting a plurality of cutters thereon for engaging a subterranean rock formation, a shank portion projecting from the leading body, and a mandrel portion engaging the shank portion and defining an inseparable connection therewith. The mandrel portion extends longitudinally into the bearing housing and through the at least one annular bearing package.

28 Claims, 4 Drawing Sheets

DRILL BIT FOR A DRILLING APPARATUS

BACKGROUND OF THE DISCLOSURE

1. Technical Field

This disclosure relates generally to rotary drill bits. In particular, a drill bit of the present disclosure may be employed, e.g., in a drilling apparatus for drilling a borehole into the earth.

2. Description of Related Art

Often when drilling a borehole into the earth, a down-hole drilling motor is suspended from the lower end of a drill string. A drilling fluid may be transmitted through the drill string and circulated through the drilling motor to induce rotation of a drill bit, and the rotating drill bit engages a subterranean rock formation to produce a borehole therein. In some instances, directional drilling may be desirable, i.e., it may be desirable to produce a borehole that deviates from a vertically oriented path.

Some mechanisms employed for this purpose include a bent subassembly, integrated in the down-hole drilling motor, typically between the power section of the motor and the bearing assembly. A bent subassembly generally includes a bent or bendable structural component that supports the bearing assembly, and a drill bit at its lower end, at a slight angle to the direction of the drill string above the bent subassembly. The bent subassembly may define a fixed angle, or the angle may be adjustable. When it is desired to drill in a generally straight path, the entire drill string may be continuously rotated from the surface, and the motor may or may not be activated. When it is desired to cause the path of the borehole to diverge in a given direction, continuous rotation of the drill string is stopped, and the drill string, bent subassembly, motor and bit are oriented to in the desired direction of divergence. The upper part of the drill string is held in this position and the down-hole motor is started. This causes the borehole to diverge in the desired direction. A minimum turning radius of these mechanisms may be limited in part by a "bit-to-bend" length that may be generally described as the distance from a fulcrum point of the bent subassembly to leading face of the drill bit.

Mother type of drilling apparatus that may be employed for directional drilling is a rotary steerable system (RSS). Generally, a rotary steerable system provides some mechanism for steering the drill bit in a desired direction, usually without requiring continuous rotation of the drill string from the surface to be stopped. Many rotary steerable systems include a mechanism for providing a radial or sideways-direction force relative to the lower end of the drill string to steer the drill bit on a path that diverges from a straight path.

The drill bits employed for vertical drilling and/or directional drilling may need to be replaced for a number of reasons including wear or breakage of the surfaces contacting the subterranean rock formation. Often, drill bits are provided with a threaded interface, or another repeatable coupling, on a shank portion thereof to permit decoupling of a broken or worn drill bit from a lower portion of the motor, and replacement with a new or refurbished bit.

Advancements made in the design and usage of drill bits have made it possible to extend the expected life of a bit beyond the expected need for the bit for a particular application or project. Thus, it is now possible for a user to rent a drill bit for use on a project, and return the bit for subsequent use by another user on another project. This increase in the usable life of drill bits has affected the design considerations made in the manufacture of drill bits for down-hole drilling motors.

SUMMARY OF THE DISCLOSURE

In one embodiment of the present disclosure, a down-hole drilling apparatus includes a bearing housing defining a longitudinal axis and upper and lower portions. The upper portion of the bearing housing is configured for connection to a drill string, and at least one annular bearing package is disposed within the bearing housing. A drill bit is coupled to the bearing housing and is rotatable with respect to the longitudinal axis. The drill bit includes a leading body supporting a plurality of cutters thereon for engaging a subterranean rock formation, a shank portion projecting from the leading body, and a mandrel portion engaging the shank portion and defining an inseparable connection therewith. The mandrel portion extends longitudinally into the bearing housing and through the at least one annular bearing package.

According to another embodiment of the present disclosure, a rotary steerable system includes a housing having an upper end and a lower end, wherein the upper end of the housing is configured for connection to a drill string. The rotary steerable system also includes a steering mechanism operable to provide a lateral force relative to the lower end of the housing, and a drill bit disposed at least partially within the housing. The drill bit includes a leading body supporting a plurality of cutters that are configured to engage a subterranean rock formation, and a mandrel portion inseparably coupled with the leading body. The mandrel portion extends longitudinally into the housing.

According to another embodiment of the present disclosure, a drill bit for use in a drilling apparatus includes a leading body supporting a plurality of cutters thereon, and a mandrel portion inseparably coupled with the leading body. The mandrel portion is adapted to extend into a housing of the drilling apparatus and to rotate therein. The mandrel portion includes at least one engagement surface thereon for engaging at least one annular bearing.

BRIEF DESCRIPTION OF THE DRAWINGS

The present disclosure is best understood from the following detailed description when read with the accompanying figures. In accordance with the standard practice in the industry, various features may not be drawn to scale.

DESCRIPTION OF EMBODIMENTS

It is to be understood that the following disclosure provides many different embodiments, or examples, for implementing different features of various embodiments. Specific examples of components and arrangements are described below to simplify the present disclosure. These are, of course, merely examples and are not intended to be limiting.

Figure 1A:
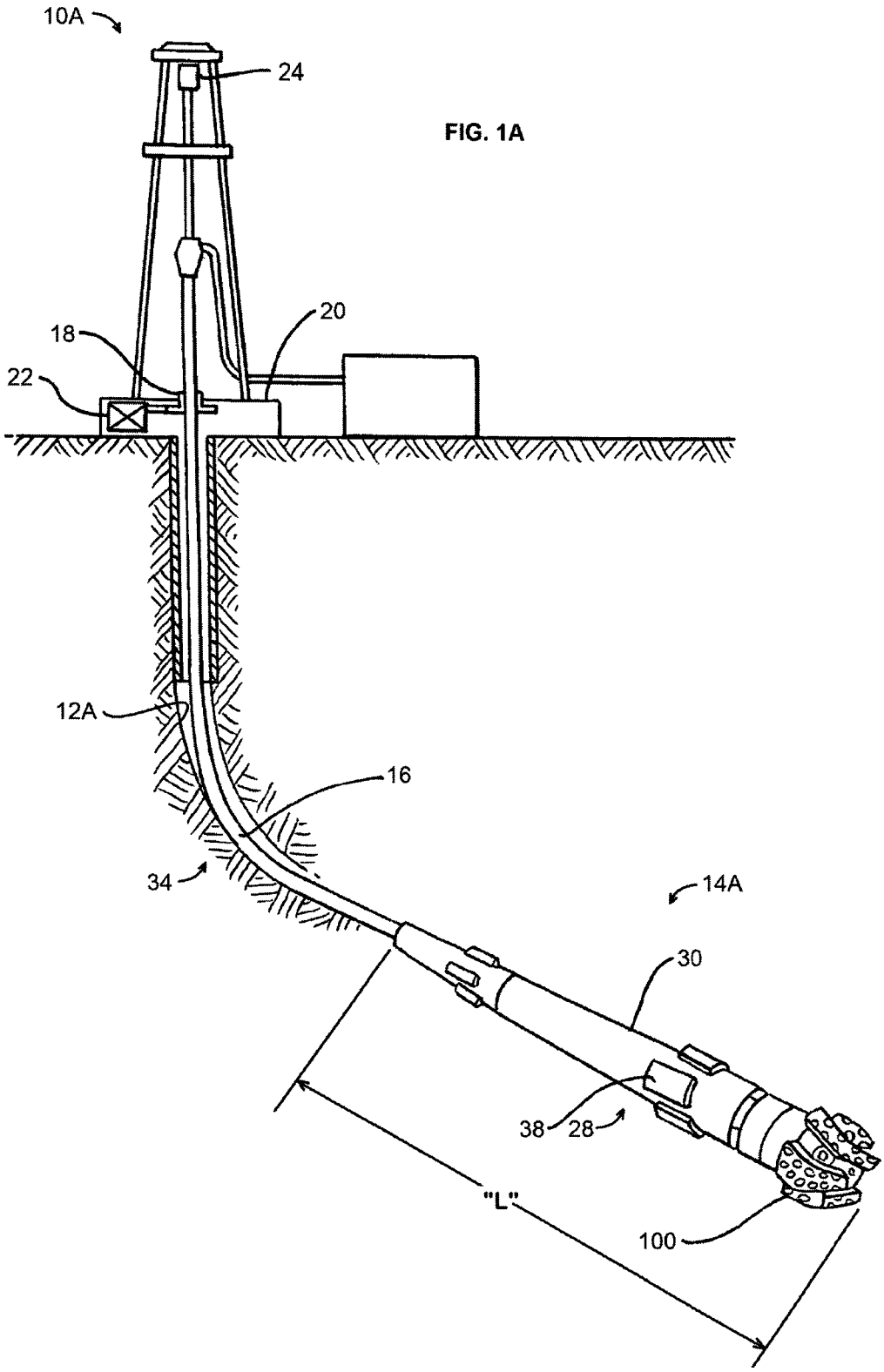
FIG. 1A is cross-sectional view of a borehole that deviates from the vertical and contains drilling apparatus including a rotary steerable system in accordance with the present disclosure.

FIG. 1A illustrates one embodiment of a drilling apparatus 10A that may be employed to drill borehole 12A into the earth. The drilling apparatus 10A includes a drill bit 100 at leading end thereof in accordance with the present disclosure. The drill bit 100 is a component of a bottom-hole assembly 14A, which comprises a rotary steerable system coupled to a lower end of drill string 16. The drill string 16 may be rotatably driven from the surface by a rotary table 18 on a drilling platform 20, and the rotary table 18 may be driven by a motor 22. A draw works 24 is provided for raising and lowering the drill string 16 and for applying weight to, and relieving weight from the drill bit 100.

The bottom-hole assembly 14A includes a bearing section 28, which permits rotary motion of the drill bit 100 with respect to the drill string 16. The bottom-hole assembly 14A also includes a steerable section 30, which may be employed to maintain or change the general heading of the drill bit 100 as the bottom-hole assembly 14A penetrates deeper into the earth. For example, the steerable section 30 may be employed to generate a bend 34 in the borehole 12A such that the borehole 12A deviates from the vertical. To achieve a bend such as bend 34, the steerable section 30 includes radially-extensible, side-force exertion elements 38 that selectively engage a sidewall of the borehole 12A. The side-force exertion elements 38 are described in greater detail in U.S. Pat. No. 7,287,605, the entire content of which is hereby incorporated by reference. It will be recognized that various other steering mechanisms may be employed within the scope of the present disclosure.

The achievable sharpness of the bend 34 generated by the drilling apparatus 10A is in part a function of the geometry and structural characteristics of the bottom-hole assembly 14A. The bottom-hole assembly 14A defines an overall length "L" that generally corresponds indirectly to the achievable sharpness of the bend 34, i.e., a shorter overall length "L" may yield a sharper bend 34 and a longer overall length "L" may yield a bend 34 that is relatively gradual.

Figure 1B:
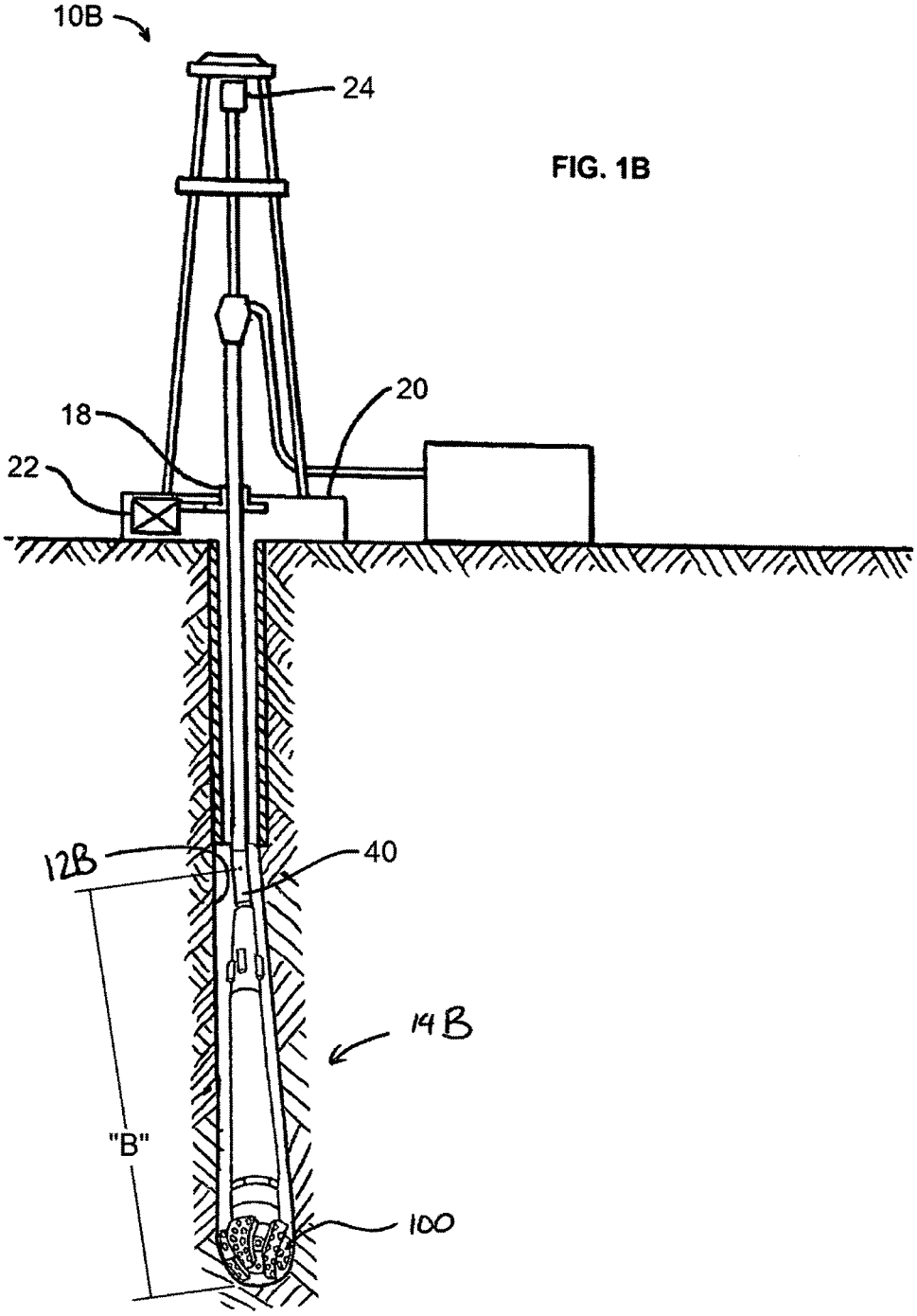
FIG. 1B is a cross-sectional view of a borehole exhibiting a generally vertical orientation and containing an alternate embodiment of a drilling apparatus in accordance with the present disclosure that includes a bent subassembly.

The drill bit 100 may be employed in various alternate types drilling systems. For example, referring now to FIG. 1B, an alternate embodiment of a drilling apparatus 10B is depicted that includes the drill bit 100 and a bent sub 40. The drilling apparatus 10B includes surface equipment similar to the apparatus 10A (FIG. 1A) described above, which includes rotary table 18, drilling platform 20, motor 22 and draw works 24. The drilling apparatus 10B also includes a bottom-hole assembly 14B suspended below the bent sub 40. The bottom-hole assembly 14B may be rotated along with the bent sub 40 from the surface, e.g., by the rotary table 18 to produce a borehole 12B, which exhibits a generally vertical orientation. When it is desired to deviate the borehole 12B from the generally vertical orientation, the bottom-hole assembly 14B includes a power section 46 (FIG. 2), which may be activated to rotate the drill bit 100 without rotating the bent sub 40. The orientation of the bent sub 40 defines the direction of deviation.

The drilling apparatus 10B defines a bit-to-bend length "B" that contributes to an achievable sharpness of a deviation in borehole 12B. The bit-to-bend length "B" may be generally described as the distance from a fulcrum point of the bent subassembly 40 to an extreme end of the drill bit 100. Other apparatuses for directional drilling may not employ a bent subassembly, or a rotary steerable system but nevertheless define a length that contributes to the achievable sharpness of a bend in a borehole. Still other drilling apparatuses may be configured for generally vertical drilling. Any of these drilling apparatuses, whether configured for directional drilling or vertical drilling, may employ a drill bit 100 within the scope of the present disclosure.

Figure 2:
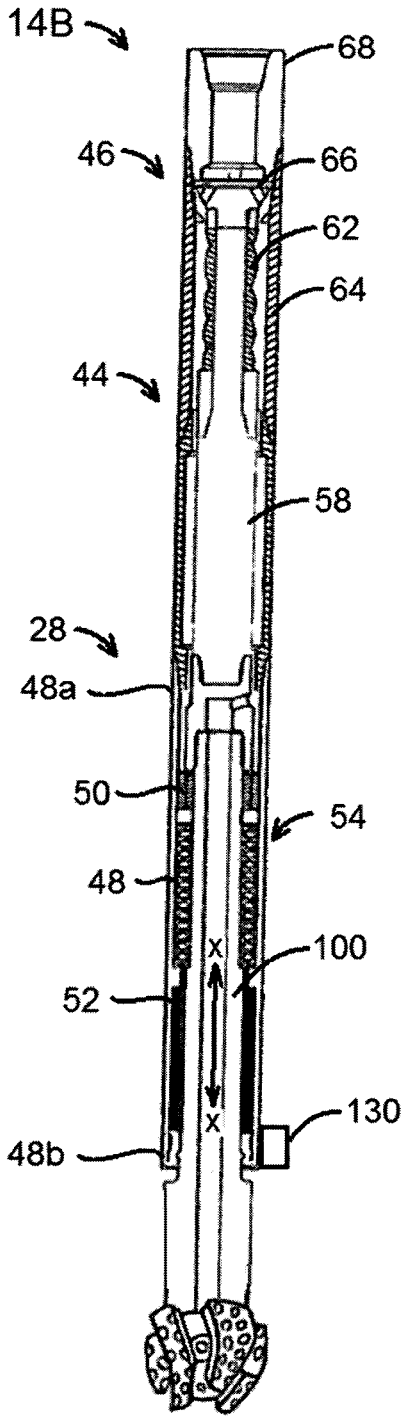
FIG. 2 is a cross-sectional side view of a bottom hole assembly including a down-hole drilling motor, and a drill bit that may be employed by either the rotary steerable system depicted in FIG. 1A or the drilling apparatus of FIG. 1B.

Referring now to FIG. 2, the bottom-hole assembly 14B includes bearing section 28, a transmission section 44, and a power section 46. The bearing section 28 includes a bearing housing 48, which defines a longitudinal axis X-X and has an upper end 48*a* and a lower end 48*b*. As used herein, the term "upper" refers to a direction or side of a component that is oriented toward the surface of a borehole, while the term "lower refers" to the direction or side of a component oriented toward the portion of the borehole most distant from the surface. Disposed within the bearing housing 48 are upper and lower radial bearings 50 and 52, and a thrust bearing package 54 to support rotational motion of the drill bit 100. The radial bearings 50 and 52 accommodate radial loads experienced by the drill bit 100, and may comprise at least one annular member defining a circumferential bearing surface. The radial bearings 50 and 52 may be constructed, e.g., from cemented tungsten carbide, or a suitable ceramic, metal, or other bearing material. The thrust bearing package 54 is provided primarily to accommodate vertical or longitudinal loads, and may comprise ball bearings movable through annular races, polycrystalline diamond compact (PDC) bearings, or other suitable arrangements as known in the art. The drill bit 100 extends longitudinally through each of the bearings 50, 52, 54, and protrudes from the lower end 48*b* of the bearing housing 48. The bearing section 28 may be also be employed by bottom-hole assembly 14A.

The transmission section 44 includes a transmission 58 therein that serves to transmit mechanical motion, e.g., rotational motion, from the power section 46 to the drill bit 100. The transmission 58 may comprise, e.g., a fixed or flexible drive shaft operably coupled to the drill bit 100. Power section 46 includes rotor 62, stator 64, optional rotor catch 66, and top sub 68. The top sub 68 provides an interface for the connection of bottom-hole assembly 14 with the drill string 16. As is common with down-hole drilling motors, the power section 46 is configured such that transmission of a drilling fluid therethrough induces rotational motion of the rotor 62 with respect to the stator 64. The induced rotational motion of the rotor 62 may be eccentric or concentric rotational motion with respect to the stator 64.

Figure 3:
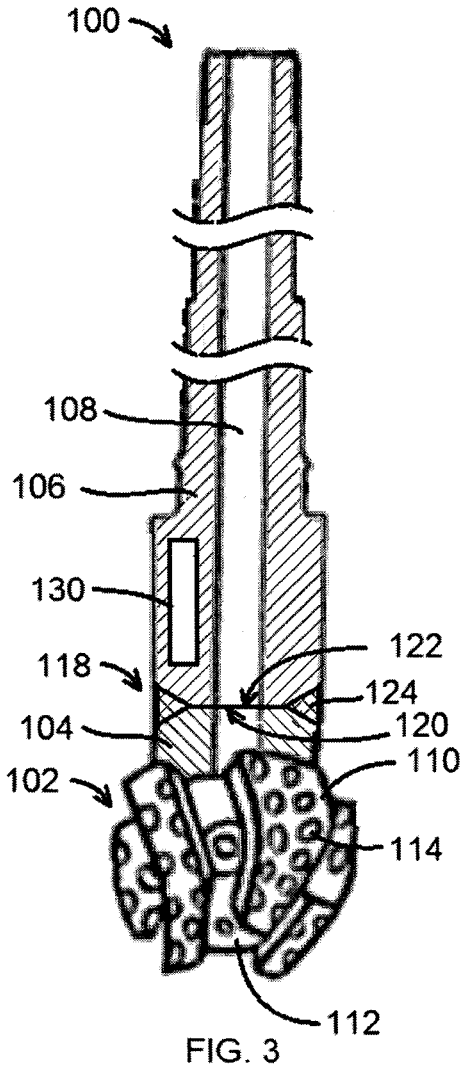
FIG. 3 is an enlarged cross-sectional side view of the drill bit of FIG. 2 illustrating an inseparable connection between a mandrel portion and shank portion of the drill bit.

Referring now to FIG. 3, the drill bit 100 generally includes a leading body 102, a shank portion 104, and a mandrel portion 106. A longitudinal passageway 108 is defined through the drill bit 100 to permit passage of a drilling fluid therethrough.

The leading body 102 includes a plurality of blades 110 protruding from a central core 112. The central core 112 may be constructed of a hardened steel alloy or stainless steel, and the blades 110 may be subsequently affixed to the core 112 by fasteners, welding, molding, etc. A plurality of cutters 114 are mounted to the blades 110. The cutters 114 may comprise surfaces formed of tungsten carbide, PCD or another material suitable for engaging a subterranean rock formation. It will be recognized that other configurations of the leading body 102 are contemplated such as those configurations found in rolling cone bits, or the like. The shank portion 104 protrudes from the leading body and provides mating surfaces for engaging the mandrel portion 106. The shank portion 104 may be formed integrally or monolithically with the core 112 of the leading body 102, e.g., from the same piece of material by forging, rolling, extruding, etc., or coupled to the core 112 by welding or a similar process.

The mandrel portion 106 abuts the shank portion 104 and defines an inseparable connection 118 therewith. As used throughout this specification, the term "inseparable" is intended to mean that the connection 118 may not readily be disassembled without damaging or destroying the connected components. The inseparable connection 118 is depicted as a butt-welded connection established between adjoining faces 120, 122 of the mandrel portion 106 and the shank portion 106 respectively. The butt-welded connection 118 is characterized by a weld 124 wherein the base materials of the shank portion 104 and the mandrel portion 106 have been heated beyond their respective melting temperatures so as to fuse together in a region generally within an outer circumference of both of the adjoining faces 120, 122. The adjoining faces 120, 122 may be constructed in generally the same size and shape so the shank portion 104 and the mandrel portion 106 form a continuous annular shape in the region of the weld 124.

Figure 4A:
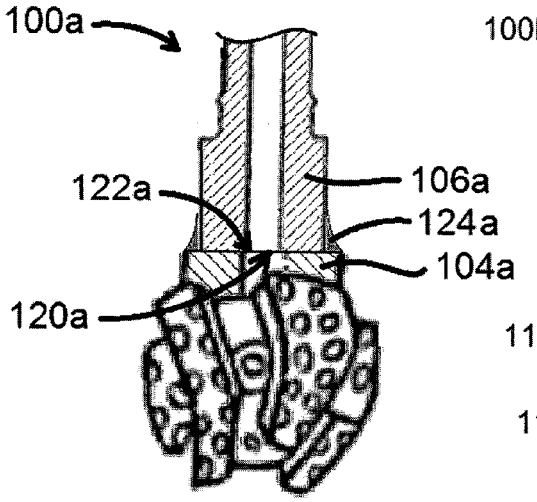
FIGS. 4A, 4B and 4C are a schematic views of alternate embodiments of drill bits including inseparable connections between a mandrel portion and a shank portion thereof.

In other embodiments, such as the embodiment depicted in FIG. 4A, a drill bit 100*a* includes a shank portion 104*a* and mandrel portion 106*a* of dissimilar size and shape. The mandrel portion 106*a* and the shank portion 104*a* engage one another across adjoining faces 120*a*, 122*a*, and since the mandrel portion 106*a* exhibits a smaller cross section than the shank portion 104*a*, the face 122*a* extends radially beyond the adjoining face 120*a*. This arrangement permits a circumferential fillet weld 124*a* to be formed along a portion of the face 122*a* that projects radially beyond the mandrel portion 106*a*.

In still other embodiments, an inseparable connection may be established by mechanisms other than welding wherein the base materials are not melted. For example, a soldered connection may be established wherein a filler material, or solder (usually a tin, lead or silver alloy), is melted and flowed into the joint between the mandrel portion 106 and shank portion 104 without melting the base material of either of the mandrel portion 106 and shank portion 104. Alternatively, a brazed connection may be established. Brazing generally involves melting a filler material (usually brass) at higher temperatures than are employed in soldering (typically more than 450° C.), and flowing the filler material into the joint between the mandrel portion 106 and shank portion 104.

Figure 4B:
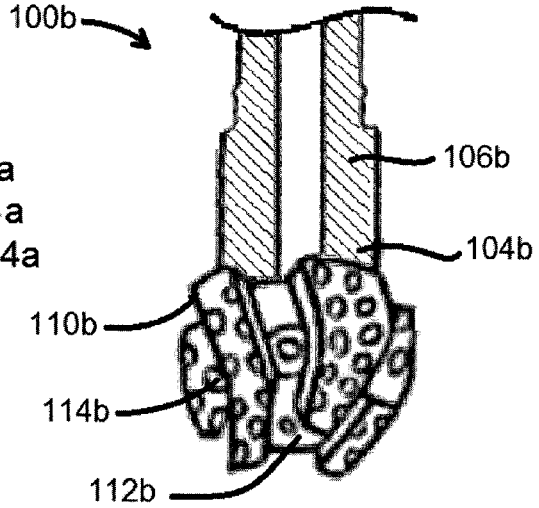

Still other mechanisms might include shrink-fitting, wherein one of the mandrel portion 106 and the shank portion 104 is cooled or frozen to permit engagement with the other, and wherein an interference fit is established by the re-expansion of the cooled or frozen component returning to a nominal temperature. Also, a drill bit 100*b* may be provided wherein a mandrel portion 106*b*, shank portion 104*b* and/or a central core 112*b* may be integrally or monolithically formed as a single component as depicted in FIG. 4B. The mandrel portion 106*b*, shank portion 104*b* and central core 112*b* may be machined as a single part from a single piece of material. Blades 110*b* and cutters 114*b* may then be welded, braised, or soldered to the central core 112*b*. The blades 100*b* and cutters 114*b* may also be affixed with adhesives. The blades 110*b*, central core 122*b* or other portions of the drill bit 100*b* may be impregnated with super hard abrasive particles (in addition to or as an alternative to cutters 114*b*) such that the drill bit 100*b* may be characterized as an impregnated bit or "impreg bit."

Figure 4C:
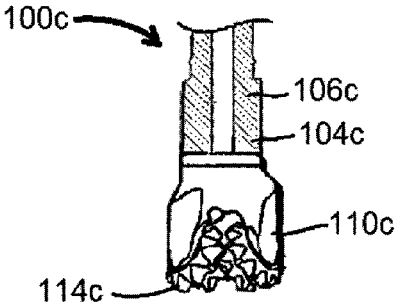

Other embodiments, as depicted in FIG. 4C, may be characterized as a roller cone bit 100*c*. Roller cone bit 100*c* includes a plurality of rolling cones 110*c* including a plurality of cutters 114*c* arranged thereon. The rolling cones 110*c* are coupled to a mandrel portion 106*c* and a shank portion 104*c*, which are formed monolithically from a single piece of material or otherwise coupled with an inseparable connection. Still other embodiments may include a mandrel portion, shank portion and central core molded together as a matrix of dissimilar materials.

Figure 5:
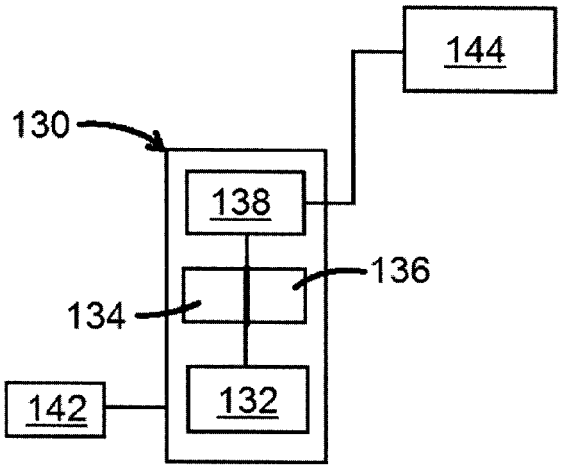
FIG. 5 is a block diagram illustrating a measurement-while-drilling/logging-while-drilling apparatus for use with the bottom-hole assembly of FIG. 2.

Referring again to FIGS. 2 and 3, a measurement/logging-while-drilling package 130 is included in a near-bit subassembly. The measurement/logging-while-drilling package 130 may be supported on the bearing housing 48 (FIG. 2), on the mandrel portion 106 (FIG. 3), or in another suitable location. As indicated in FIG. 5, this package 130 includes a power supply 132, which may include batteries, turbines driven by drilling fluids, etc., data processing circuitry 134, data storage devices 136 and data transmission devices 138, which may include wires, mud pulse telemetry devices, etc. The measurement/logging-while-drilling package 130 is connected to one or more sensors 142 disposed in the bottom-hole assembly 14. The one or more sensors 142 are adapted to make measurements related to a drilling operation such as torque and weight-on-bit, and/or measurements related to a subterranean rock formation such as resistivity or density of the formation. The measurement/logging-while-drilling package 130 is in communication with a receiver 144, which may be disposed at the surface of a borehole 12A, 12B such that information may be transmitted uphole to the receiver 144.

In some embodiments, the measurement/logging-while-drilling package 130 includes a magnetometer configured to make measurements of the strength and direction of magnetic fields. A magnetometer may also be provided independently of the measurement/logging-while-drilling package 130. The drill bit 100, 100*a*, 100*b* and other housing and drive components in such embodiments may be constructed of non-magnetic or nonferrous material such as aluminum, titanium or a similar alloy. A non-magnetic or nonferrous alloy facilitates measurements of the magnetometer.

It will be appreciated that the bit-to-bend length "B" of the bottom-hole assembly 14B, and/or the overall length "L" of the bottom-hole assembly 14A, is relatively short. For instance, by employing an inseparable connection 118 between the mandrel portion and the shank portion 104, rather than a repeatable coupling, the bit-to-bend length "B," or overall length "L," may be about 4 to about 5 inches shorter. Thus, the bottom-hole assemblies 14A and 14B may undergo relatively sharp changes in direction during directional drilling. Also, there may be less expense associated with an inseparable coupling 118 in certain applications such as "factory style" drilling operations where multiple boreholes may be drilled simultaneously with an emphasis on standardization.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. A down-hole drilling apparatus comprising;

a bearing housing defining a longitudinal axis and upper and lower portions, the upper portion of the bearing housing configured for connection to a drill string;

at least one annular bearing package disposed within the bearing housing; and a central core of a drill bit coupled to and substantially positioned at a lower end of the bearing housing, the central core rotatable with respect to the longitudinal axis, the central core having blades coupled thereto, the blades supporting a plurality of cutters thereon, the cutters configured to engage a subterranean rock formation;

a shank portion projecting from the central core, the shank portion formed integrally or monolithically with the central core or inseparably coupled to the central core; and a mandrel portion engaging the shank portion and defining an inseparable connection therewith, the inseparable connection not including a repeatable coupling, the overall length of the down-hole drilling apparatus being shorter than a down-hole drilling apparatus including a repeatable coupling; the mandrel portion extending longitudinally into the bearing housing and through the at least one annular bearing package.

2. The down-hole drilling apparatus according to claim 1, wherein the inseparable connection is a welded connection established between adjoining faces of the shank portion and the mandrel portion.

3. The down-hole drilling apparatus according to claim 2, wherein the adjoining faces are unequal in size, and wherein the welded connection defines an annular fillet weld.

4. The down-hole drilling apparatus according to claim 1, wherein the inseparable connection is selected from the group consisting of a brazed connection, a soldered connection, a molded connection of matrix materials, and a monolithically formed mandrel, shank portion and central core.

5. The down-hole drilling apparatus according to claim 1, further comprising a motor including a rotor, wherein the rotor is adapted to be driven by drilling fluids, and wherein the rotor is operably coupled to the drill bit to provide rotational motion thereto.

6. The down-hole drilling apparatus according to claim 1, further comprising a steering mechanism operable to provide a lateral force relative to the lower end of the bearing housing thereby enabling a general heading of the drill bit to be adjusted.

7. The down-hole drilling apparatus according to claim 1, further comprising a measurement-while-drilling/logging-while-drilling package disposed on at least one of the bearing housing and the drill bit, the measurement-while-drilling/logging-while-drilling package in communication with at least one sensor adapted to make measurements related to a drilling operation.

8. The down-hole drilling apparatus according to claim 7, wherein the measurement-while-drilling/logging-while-drilling package includes a transmission device adapted to communicate information related to measurements made by the at least one sensor to a receiver at the surface of a borehole.

9. The down-hole drilling apparatus according to claim 7, wherein the at least one sensor includes a magnetometer, and wherein the mandrel portion and the shank portion are constructed of a non-magnetic material.

10. The down-hole drilling apparatus according to claim 1, wherein the at least one annular bearing package includes upper and lower radial bearings longitudinally spaced from one another and a thrust bearing package disposed longitudinally between the upper and lower radial bearings.

11. The down-hole drilling apparatus according to claim 10, wherein the thrust bearing package includes at least one ball bearing movable through at least one race.

12. The down-hole drilling apparatus according to claim 1, wherein the plurality of cutters is arranged on a plurality of rolling cones.

13. A rotary steerable system comprising:

a housing including an upper end and a lower end, an upper end of the housing adapted for connection to a drill string;

a steering mechanism operable to provide a lateral force relative to the lower end of the housing; and a drill bit disposed at least partially within the housing, the drill bit comprising:

a central core having blades coupled thereto, the blades supporting a plurality of cutters thereon, the cutters configured to engage a subterranean rock formation; and a mandrel portion coupled with the central core by an inseparable connection, the inseparable connection not including a repeatable coupling, the overall length of the down-hole drilling apparatus shorter than a down-hole drilling apparatus including a repeatable coupling, the mandrel portion extending longitudinally into the housing.

14. The rotary steerable system according to claim 13, further comprising at least one annular bearing package disposed within the housing, the annular bearing package including a bearing stator and a bearing rotor engaged with one another at a bearing interface, wherein the bearing stator is supported by the housing so as to remain relatively stationary relative to the housing, and wherein the bearing rotor engages the mandrel portion of the drill bit so as to rotate along therewith relative to the housing.

15. The rotary steerable system according to claim 13, further comprising a measurement-while-drilling/logging-while-drilling package disposed on the housing, the measurement-while-drilling/logging-while-drilling package in communication with at least one sensor adapted to make measurements related to a drilling operation.

16. A drill bit for use in a drilling apparatus; the drill bit comprising;

a central core having blades coupled thereto, the blades supporting a plurality of cutters thereon, the cutters configured to engage a subterranean rock formation; and a mandrel portion coupled with the central core by an inseparable connection, the inseparable connection not including a repeatable coupling, the overall length of the down-hole drilling apparatus being shorter than a down-hole drilling apparatus including a repeatable coupling, the mandrel portion adapted to extend into a housing of the drilling apparatus system and to rotate therein, the mandrel portion including at least one engagement surface thereon for engaging at least one annular bearing.

17. A down-hole drilling apparatus comprising;

a bearing housing defining a longitudinal axis and upper and lower portions, the upper portion of the bearing housing configured for connection to a drill string;

at least one annular bearing package disposed within the bearing housing; and a central core of a drill bit coupled to and substantially positioned at a lower end of the bearing housing, the central core rotatable with respect to the longitudinal axis, the central core having blades coupled thereto, the blades supporting a plurality of cutters thereon, the cutters configured to engage a subterranean rock formation, the drill bit being a roller cone drill bit;

a shank portion projecting from the central core, the shank portion formed integrally or monolithically with the central core or inseparably coupled to the central core; and a mandrel portion engaging the shank portion and defining an inseparable connection therewith, the inseparable connection not including a repeatable coupling, the inseparable connection being shorter than a connection including a repeatable coupling; the mandrel portion extending longitudinally into the bearing housing and through the at least one annular bearing package.

18. The down-hole drilling apparatus according to claim 17, wherein the inseparable connection is a welded connection established between adjoining faces of the shank portion and the mandrel portion.

19. The down-hole drilling apparatus according to claim 18, wherein the adjoining faces are unequal in size, and wherein the welded connection defines an annular fillet weld.

20. The down-hole drilling apparatus according to claim 17, wherein the inseparable connection is selected from the group consisting of a brazed connection, a soldered connection, a molded connection of matrix materials, and a monolithically formed mandrel, shank portion and central core.

21. The down-hole drilling apparatus according to claim 17, further comprising a motor including a rotor, wherein the rotor is adapted to be driven by drilling fluids, and wherein the rotor is operably coupled to the drill bit to provide rotational motion thereto.

22. The down-hole drilling apparatus according to claim 17, further comprising a steering mechanism operable to provide a lateral force relative to the lower end of the bearing housing thereby enabling a general heading of the drill bit to be adjusted.

23. The down-hole drilling apparatus according to claim 17, further comprising a measurement-while-drilling/logging-while-drilling package disposed on at least one of the bearing housing and the drill bit, the measurement-while-drilling/logging-while-drilling package in communication with at least one sensor adapted to make measurements related to a drilling operation.

24. The down-hole drilling apparatus according to claim 23, wherein the measurement-while-drilling/logging-while-drilling package includes a transmission device adapted to communicate information related to measurements made by the at least one sensor to a receiver at the surface of a borehole.

25. The down-hole drilling apparatus according to claim 23, wherein the at least one sensor includes a magnetometer, and wherein the mandrel portion and the shank portion are constructed of a non-magnetic material.

26. The down-hole drilling apparatus according to claim 17, wherein the at least one annular bearing package includes upper and lower radial bearings longitudinally spaced from one another and a thrust bearing package disposed longitudinally between the upper and lower radial bearings.

27. The down-hole drilling apparatus according to claim 26, wherein the thrust bearing package includes at least one ball bearing movable through at least one race.

28. The down-hole drilling apparatus according to claim 17, wherein the plurality of cutters is arranged on a plurality of rolling cones.

* * * * *